US008120452B2

(12) United States Patent
Holland

(10) Patent No.: US 8,120,452 B2
(45) Date of Patent: Feb. 21, 2012

(54) MECHANICAL INTERLOCK FOR CIRCUIT BREAKER TO PREVENT RELATCHING OF THE BREAKER

(75) Inventor: Michael J. Holland, Hilliard, OH (US)

(73) Assignee: Siemens Industry, Inc., Alpharetta, GA (US)

( * ) Notice: Subject to any disclaimer, the term of this patent is extended or adjusted under 35 U.S.C. 154(b) by 368 days.

(21) Appl. No.: 12/372,830

(22) Filed: Feb. 18, 2009

(65) Prior Publication Data

US 2009/0206964 A1 Aug. 20, 2009

Related U.S. Application Data

(60) Provisional application No. 61/029,588, filed on Feb. 19, 2008.

(51) Int. Cl.
*H01H 67/02* (2006.01)

(52) U.S. Cl. ..... 335/120; 335/172

(58) Field of Classification Search ..... 335/6, 21–25, 335/35, 42, 45, 167–176, 202, 120; 200/293–305; 29/602.1

See application file for complete search history.

(56) References Cited

U.S. PATENT DOCUMENTS

| | | | | |
|---|---|---|---|---|
| 3,808,386 | A * | 4/1974 | Strobel | 200/401 |
| 3,815,058 | A * | 6/1974 | Stetsuk | 335/8 |
| 3,959,752 | A * | 5/1976 | Strobel et al. | 335/10 |
| 4,246,557 | A * | 1/1981 | Michetti et al. | 335/17 |
| 4,528,531 | A | 7/1985 | Flick | |
| 6,157,275 | A | 12/2000 | Gula | |

* cited by examiner

*Primary Examiner* — Bernard Rojas

(57) ABSTRACT

An apparatus and method for restricting auxiliary latch movement within a tripped circuit breaker. An auxiliary latch is held in a closed state and is biased into an open state. When the trip bar is activated in response to an overload condition, it releases the auxiliary latch which pivots to the open state. The cradle is released and pivots to disengage the breaker contact. Tabs on the cradle and auxiliary latch cooperatively interlock to limit auxiliary latch movement until the latch is properly reset.

19 Claims, 2 Drawing Sheets

MECHANICAL INTERLOCK FOR CIRCUIT BREAKER TO PREVENT RELATCHING OF THE BREAKER

RELATED APPLICATION INFORMATION

This application claims priority to provisional application Ser. No. 61/029,588 filed on Feb. 19, 2008 the contents of which are incorporated herein by reference thereto.

BACKGROUND

1. Technical Field

This disclosure relates generally to the field of electrical circuit breakers and more particularly to a mechanical interlock feature that engages upon circuit breaker tripping.

2. Description of the Related Art

In general, circuit breakers are employed to selectively engage a branch circuit to an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are several ways by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism; or auxiliary devices can be used to trip the circuit breaker thereby move the movable contact. For many circuit breakers, the operating handle is coupled to the operating mechanism such that when the tripping mechanism activates the operating mechanism to separate the contacts, the operating handle moves to a fault or tripped position.

When an overload condition occurs, the trip bar is rotated away allowing the trip bar latch to disengage the auxiliary latch. With the auxiliary latch free, the cradle is able to pivot thereby disengaging the breaker contacts. This sequence of event is referred to as the breaker tripping. In order for the breaker to be safely reset, the auxiliary latch must be held open until the cradle is first reset. According to the prior art, a variety of heavy springs and dampers are used to keep the auxiliary latch from resetting prematurely. In addition a push to trip button could be used to trip the mechanism again.

The disadvantage of the prior art systems are that there is no guarantee that the auxiliary latch will not reset after the breaker is tripped. In addition, using some type of damper will add extra cost to the mechanism. Using a heavier torsion spring could make the auxiliary latch rebound thereby allowing itself to reset with the trip bar latch. The cradle could not be reset in this case as it would strike the top of the auxiliary latch.

Accordingly, there is a need for a secure feature that will prevent the auxiliary latch from resetting prematurely.

SUMMARY OF THE INVENTION

An apparatus for restricting auxiliary latch movement within a tripped circuit breaker having an auxiliary latch held in a closed state and being biased into an open state. A cradle disengages the breaker contact when the auxiliary latch moves into the open state. An interlock limits the auxiliary latch from exiting the open state until the cradle is properly reset. The interlock comprises complementary interfering parts on the auxiliary latch and the cradle which physically prevent the auxiliary latch from exiting the open state when the cradle is disengaged. One interfering part is an auxiliary latch tab which is disposed on said auxiliary latch. Another interfering part is a cradle tab which is disposed on said cradle.

The cradle pivots to a disengaged position where the cradle tab is disposed at a radial distance R from the auxiliary latch axis, corresponding to the radial location of the auxiliary latch tab, thereby preventing the auxiliary latch from pivoting out of its open state. The cradle synchronously pivots with an auxiliary latch surface for selective meshing and unmeshing, with the auxiliary latch tab and the cradle tab cooperatively interlocking in the unmeshed state to maintain said auxiliary latch in proper rotational alignment for subsequent meshing upon cradle resetting. A trip bar latch holds said auxiliary latch in a closed state until the breaker trips. The interlock restricts said auxiliary latch from pivoting back into the closed state thereby avoiding accidental trip bar reset.

Another embodiment of the invention includes a method of restricting auxiliary latch movement within a tripped circuit breaker, including selectively meshing an auxiliary latch with a cradle via synchronous pivoting on respective parallel axes. Next, the auxiliary latch pivots out of mesh with the cradle allowing it to disengage the breaker contact. The auxiliary latch and the cradle are interlocked to prevent the auxiliary latch from exiting the open state until the cradle is reset.

These and other objects, features and advantages of the present invention will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

Figure 1:
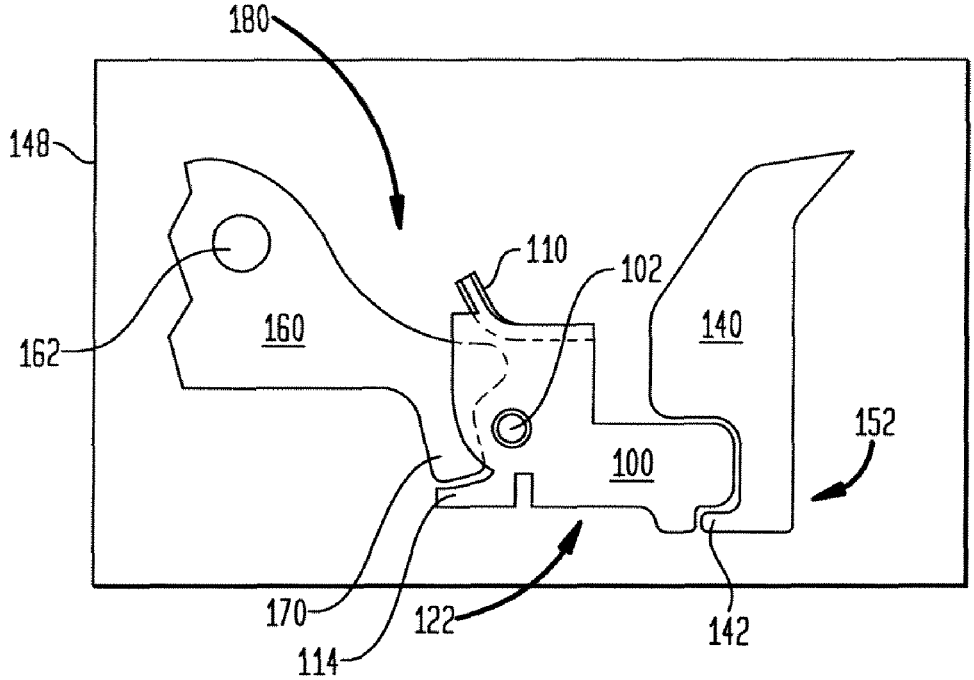
FIG. 1 is a side schematic view of a circuit breaker interlock feature in accordance with one illustrative embodiment.
Figure 3A:
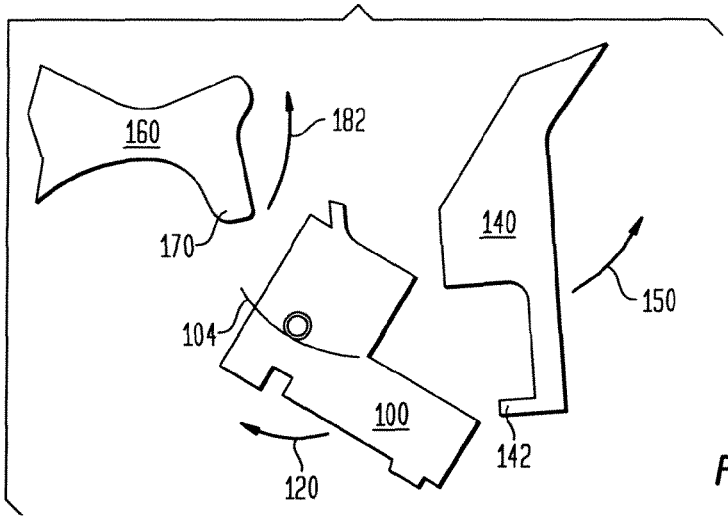
FIGS. 3A, 3B and 3C are a series of side schematic views of a circuit breaker in a tripped condition in accordance with one illustrative embodiment.

The present invention provides devices and methods relating to an interlock feature which prevents the auxiliary latch from improperly reengaging the trip bar latch. It is used in a breaker mechanism to restrict the auxiliary latch from reengaging after the breaker has been tripped, i.e. to prevent a nuisance relatch. If the auxiliary latch is reengaged before the cradle is in place, then the breaker cannot be reset. In FIG. 1, the circuit breaker 148 is set in the on position. When an overload condition occurs a series of actions lead to the tripped condition shown in FIG. 3A. More particularly, when trip bar 140 is tripped, the trip bar latch 142 releases auxiliary latch 100 which pivots to the open position wherein cradle 160 is free to move into the disengaged state. Movement of the auxiliary latch 100 back into the closed position should be initiated when the cradle 160 is reset to the engaged position 180. However, auxiliary latch rebound could follow a breaker trip, whereby trip bar 140 gets reset prematurely, i.e. before the latch is reengaged, as shown in FIG. 3C. The interlock 130 of FIG. 3B restricts the movement of auxiliary latch in the tripped condition, until the cradle is reset.

The present principles will be described in terms of single pole circuit breakers employed for residential applications. However, the embodiments described are not limited to the illustrative example and may be employed in other configurations for other applications. For example, the present principles are equally applicable to two or more pole mechanisms, breakers that include push to test features, any size breakers, multiple breaker systems in a single housing, etc. Moreover, all statements herein reciting principles, aspects, and embodiments of the invention, as well as specific examples thereof, are intended to encompass both structural and functional equivalents thereof. For example, reference to clockwise and counter clockwise are provided for explanatory purposes and are non-limiting. The alternate or opposite directions are intended to be included within the concepts and mechanisms described herein. Additionally, it is intended that such equivalents include both currently known equivalents as well as equivalents developed in the future (i.e., any elements developed that perform the same function, regardless of structure).

Thus, for example, it will be appreciated by those skilled in the art that the drawings presented herein represent conceptual views of illustrative system components embodying the principles of the invention. Referring now in specific detail to the drawings in which like reference numerals identify similar or identical elements throughout the several views, and initially to FIG. 1, there is shown a schematic internal view of an auxiliary latch 100, a trip bar 140 and a cradle 160 of a circuit breaker 148 set in the on position. When an overload condition occurs a trip bar initiates a sequence of movements that shut off power through the breaker and place it in a tripped condition. The final tripped condition is shown in FIG. 3A. A problem with certain prior art designs can lead to auxiliary latch rebound, where the trip bar gets reset before the cradle is reengaged, as shown in FIG. 3C. The interlock feature 130, according to an embodiment of the invention, keeps the auxiliary latch in its open position until the cradle initiates movement of the auxiliary latch back to the closed position.

In general, all breakers have mechanisms that engage and disengage the electrical contacts when operated by the handle. In addition to those two functions, the mechanism must be able to trip automatically when an overload condition occurs. The part called the cradle engages with the auxiliary latch. The auxiliary latch in turn engages a trip bar latch. When the trip bar is rotated in a first direction the trip bar latch disengages the auxiliary latch allowing the cradle to push the auxiliary latch in a second direction and disengage the breaker contacts. This action is referred to as the breaker tripping.

When the breaker is reset after being tripped the operator moves the handle which is attached to the cradle. The cradle than engages the auxiliary latch moving it in the first direction to the reset position allowing the trip bar latch to engage the auxiliary latch thus locking the cradle in place. Once the cradle is locked in place the breaker can be turned to the on position reengaging the electrical contacts. The function of the invention is to keep the auxiliary latch from resetting against the trip bar latch before the cradle is reset.

If the auxiliary latch is reset before the cradle is reset then the cradle will run into the auxiliary latch, and the breaker will not be able to be reset. In prior art devices, a variety of heavy springs and dampers are used to keep the auxiliary latch from resetting. In addition a push to trip button could be used to trip the mechanism again. The disadvantages of the prior art systems are that there is no guarantee that the auxiliary latch will not reset after the breaker is tripped. In addition using some type of damper will add extra cost to the mechanism. Using a heavier spring could make the auxiliary latch rebound thereby allowing itself to reset with the trip bar latch. The cradle could not be reset in this case as it would strike the top of the auxiliary latch.

The advantage of the invention is that there is no physical way the auxiliary latch can reset while the breaker is tripped. The tab on the auxiliary latch engages a tab on the cradle. The cradle has to be reset before it is possible for the auxiliary latch to be reset. In addition to preventing reset, the tab on the auxiliary latch is bent with a radius which improves the trip characteristics of the mechanism by removing the sharp edge off of the auxiliary latch.

By way of comparison there is shown schematically several components that interact when a breaker transitions from the on or reset position to the tripped position. The "on" position is shown in FIG. 1 wherein trip bar 140 is in the reset condition 152; the auxiliary latch 100 is in the closed state 122; and the cradle 160 is in the engaged position 180. The "tripped" position is shown in FIG. 3A wherein trip bar 140 is in the tripped condition 150; auxiliary latch 100 is in the open state 120; and cradle 160 is in the disengaged position 182.

Typically, a reset occurs by manual movement of a handle which is connected to cradle 160 and extends outside of the circuit breaker 148 housing. Starting from the orientation of FIG. 3A, cradle 160 is pivoted about its axis, formed as an axle 162, clockwise toward the engaged position 180. The free end of the cradle contacts the lower plate 114 of the auxiliary latch 100 which is mounted for pivoting movement about its axis, formed as an axle 102. Auxiliary latch 100 will pivot counterclockwise to the closed state 122 where trip bar latch 142 will hold the mechanism in the reset condition 152. Trip bar latch 142 holds auxiliary latch in a closed state 122 against the force of spring 104 which is biasing auxiliary latch toward the open state 120. While a torsion spring is shown, various types of springs like coil springs and other suitable devices may be used to provide a bias of appropriate force.

Since axles 162 and 102 are parallel, the respectively mounted cradle 160 and auxiliary latch 100 interact via synchronous meshing, like gears. The free end of cradle 160 functions like one gear tooth, while auxiliary latch tab 110 and lower plate 114 function like two gear teeth. The teeth-like portions of the cradle and the auxiliary latch will selectively mesh (FIG. 1) and unmesh (FIG. 2A). When the components are unmeshed, they must remain in a certain orientation (FIG. 3A) to accommodate resetting of the latch. Sometimes, during a breaker trip, the biasing force 104 causes the auxiliary latch to rebound to an extent that trip bar latch 142 is reengaged, as shown in FIG. 3C. A problem arises because the cradle cannot be reset. The cradle tooth, is out of sync with the teeth on the auxiliary latch. Instead of meshing within auxiliary latch, the free end of the cradle is boxed out.

Figure 3B:
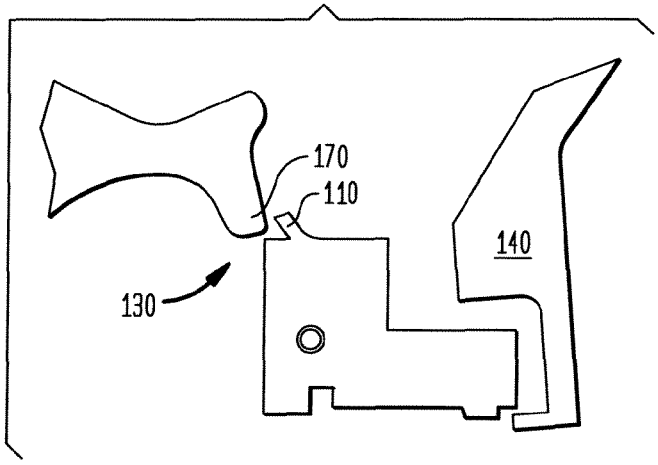
Figure 3C:
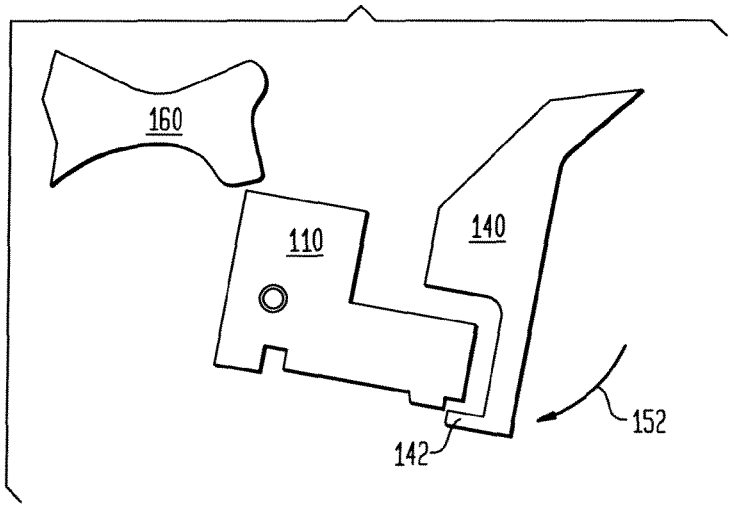
FIG. 3C (PRIOR ART)

The interlock 130 according to an embodiment of the invention is shown in FIG. 3B. The interlock is a combination of interfering tabs formed on the auxiliary latch and the cradle to restrict the movement of the auxiliary latch under a tripped condition. An auxiliary latch tab 110 is shown contacting a cradle tab 170. When cradle 160 is in the disengaged position 182, the cradle tab 160 resides in a path of auxiliary latch tab 110 to prevent it from pivoting in to the problematic orientation shown in FIG. 3C. By limiting rotation of auxiliary latch 100, the trip bar latch is prevented from accidentally resetting.

Figure 2:
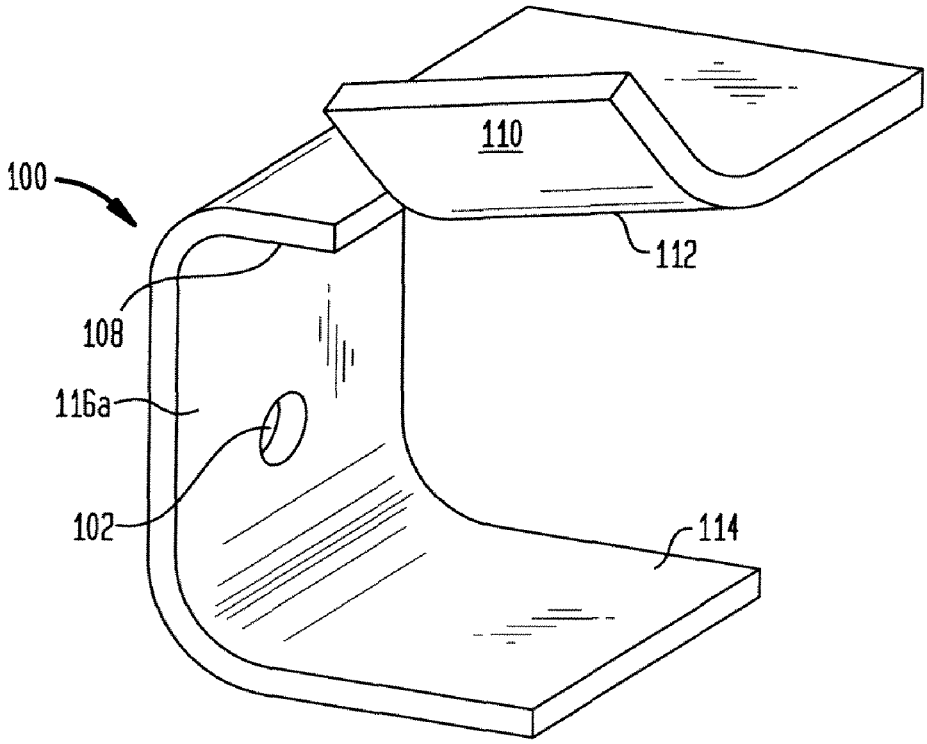
FIG. 2 is an isometric view of the auxiliary latch tab in accordance with one illustrative embodiment.

An exemplary, cross-sectional view of the back half of auxiliary latch 100 is shown in FIG. 2. Auxiliary latch is a open box-like device which wraps around four sides, with three of those sides being shown in the illustration. Starting at the bottom, a lower plate 114 is shown which wraps upwardly to a first side wall 116*a* in which the axle 102 is mounted. First side wall 116*a* the wraps around to the top which includes a lip 108. In the prior art devices, lip 108 extends across the entire top before wrapping downwardly into the second side wall (not shown for the sake of clarity). The second side wall includes a second axle 102 mounting aperture.

The disadvantage of lip 108 is clearly shown in FIG. 3C. When auxiliary latch becomes unmeshed from cradle 160 it is susceptible to over rotation in the counter-clockwise direction. Lip 108 can catch underneath the free end of cradle 170. According to one embodiment of the invention, the top side of auxiliary latch is provided with a radius surface 112 that extends smoothly into an auxiliary latch tab 110. Auxiliary latch tab extends in a generally radial direction outwardly from axis 102. A further aspect of the invention is the addition of cradle tab 170.

As can be seen in FIG. 3B, tabs 110 and 170 interlock against each other to restrict auxiliary latch 100 from pivoting into engagement with trip bar latch 142. Upon reset, the breaker handle is able to pivot cradle 160 past tab 110 into its meshed position within the box of the auxiliary latch. Cradle tab 170 will then contact lower plate 114, pivoting the auxiliary latch to the closed state 122, as shown in FIG. 1. During an overload condition, the radius surface 112 improves trip characteristics by eliminating the sharp edge of lip which was previously present.

Having described preferred embodiments for cradle and auxiliary latch interlocks for circuit breakers (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. An apparatus for restricting auxiliary latch movement within a tripped circuit breaker comprising:

an auxiliary latch held in a closed state and being biased into a first open state;

a cradle which disengages the breaker contact when said auxiliary latch moves into said first open state wherein said auxiliary latch is also moveable to a second open state and wherein said auxiliary latch is not moveable to said closed state when said auxiliary latch is in said second open state; and an interlock including complementary interfering parts on said auxiliary latch and said cradle which contact each other to block movement of said auxiliary latch to said second open state when said cradle is disengaged.

2. The apparatus of claim 1, wherein one interfering part comprises an auxiliary latch tab which is disposed on said auxiliary latch.

3. The apparatus of claim 2, wherein said auxiliary latch tab includes an auxiliary latch surface which holds said cradle in its engaged position.

4. The apparatus of claim 3, wherein said auxiliary latch surface is radius configured to allow said cradle to move past said auxiliary latch tab when said cradle is disengaging.

5. The apparatus of claim 2, wherein another interfering part comprises a cradle tab which is disposed on said cradle.

6. The apparatus of claim 5, wherein when said cradle is disengaged, said cradle tab is disposed within said auxiliary latch tab path leading back to the closed state.

7. The apparatus of claim 6, wherein during breaker reset said cradle tab is configured to slide past said auxiliary latch tab, with the cradle subsequently engaging the auxiliary latch to move said auxiliary latch into the closed state.

8. The apparatus of claim 5, wherein said auxiliary latch and said cradle are pivotally mounted on respective parallel axes.

9. The apparatus of claim 8, wherein said auxiliary latch tab extends out from said auxiliary latch in a generally radial direction to a radial distance R.

10. The apparatus of claim 9, upon disengagement said cradle pivots to a disengaged position whereby the cradle tab is disposed at a radial distance R from said auxiliary latch axis thereby preventing the auxiliary latch from pivoting out of its open state.

11. The apparatus of claim 10, wherein said cradle synchronously pivots with an auxiliary latch surface for selective meshing and unmeshing, with said auxiliary latch tab and said cradle tab cooperatively interlocking in the unmeshed state to maintain said auxiliary latch in proper rotational alignment for subsequent meshing upon cradle resetting.

12. The apparatus of claim 1, further comprising a trip bar and a trip bar latch wherein said trip bar latch holds said auxiliary latch in a closed state until the breaker trips.

13. The apparatus of claim 12, wherein said interlock restricts said auxiliary latch from pivoting back into the closed state thereby avoiding accidental trip bar reset.

14. The apparatus of claim 13, wherein pivoting the cradle into its engaged position bypasses the interlock and synchronously pivots the auxiliary latch into its closed position thereby properly resetting the trip bar.

15. A method of restricting auxiliary latch movement within a tripped circuit breaker, comprising the steps of:

selectively meshing an auxiliary latch with a cradle via synchronous pivoting on respective parallel axes;

providing an open state where the auxiliary latch pivots out of mesh with the cradle allowing it to disengage the breaker contact wherein the latch is also pivotable to a closed state and wherein when the auxiliary latch exits the open state the auxiliary latch is not moveable to the second state;

interlocking the auxiliary latch and the cradle to prevent the auxiliary latch from exiting the open state until the cradle is reset.

16. The method of claim 15, wherein interlocking comprises providing an auxiliary latch tab on said auxiliary latch to maintain synchronous alignment.

17. The method of claim 16, wherein interlocking further comprises providing a cradle tab which sits in the auxiliary latch tab path when the latch is disengaged.

18. The method of claim 17, wherein said auxiliary latch tab includes a radius configured auxiliary latch surface which holds the cradle in its engaged position and allows the cradle to move past the auxiliary latch tab when said cradle is disengaging.

19. The n ethod of claim 18, wherein the method further comprising the steps of:

providing a trip bar and a trip bar latch wherein said trip bar latch holds said auxiliary latch in a closed state until the breaker trips; and wherein interlocking restricts said auxiliary latch from pivoting back into the closed state prior to cradle resetting thereby avoiding accidental trip bar reset.

* * * * *